United States Patent [19]

Hollander

[11] Patent Number: 4,746,298

[45] Date of Patent: May 24, 1988

[54] UNIVERSAL CONNECTOR FOR THERMOCOUPLES

[75] Inventor: Milton B. Hollander, Stamford, Conn.

[73] Assignee: Omega Engineering, Inc., Stamford, Conn.

[21] Appl. No.: 885,724

[22] Filed: Jul. 15, 1986

[51] Int. Cl.[4] ..... H01R 13/02

[52] U.S. Cl. ..... 439/222; 439/223; 439/224; 439/679; 439/677

[58] Field of Search ..... 339/32 R, 32 M, 33, 339/184 M; 439/217, 221-224, 677-679

[56] References Cited

U.S. PATENT DOCUMENTS

| | | | |
|---|---|---|---|
| 2,252,454 | 8/1941 | Benander | 339/33 |
| 2,436,217 | 2/1948 | Loctov | 339/33 |
| 2,965,869 | 12/1960 | Ludwig | 339/33 |
| 2,994,849 | 8/1961 | Mussari, Jr. | 339/32 M |
| 4,243,291 | 1/1981 | Leighton | 339/184 M |

FOREIGN PATENT DOCUMENTS

| | | | |
|---|---|---|---|
| 1182741 | 1/1959 | France | 339/32 R |
| 516006 | 12/1939 | United Kingdom . | |
| 526733 | 9/1940 | United Kingdom . | |
| 630333 | 10/1949 | United Kingdom | 339/32 M |
| 1169509 | 11/1969 | United Kingdom . | |

*Primary Examiner*—Gil Weidenfeld
*Assistant Examiner*—Paula A. Austin
*Attorney, Agent, or Firm*—Warren N. Low; Renee S. Rutkowski

[57] ABSTRACT

A universal connector for polarized thermocouple leads and the like wherein a single connector replaces previously required multiple connectors and necessary adaptors. The universal connector is capable of receiving both standard-sized and smaller or miniature-sized male connectors, with resultant savings in parts and manipulative labor.

4 Claims, 1 Drawing Sheet

FIG. 1
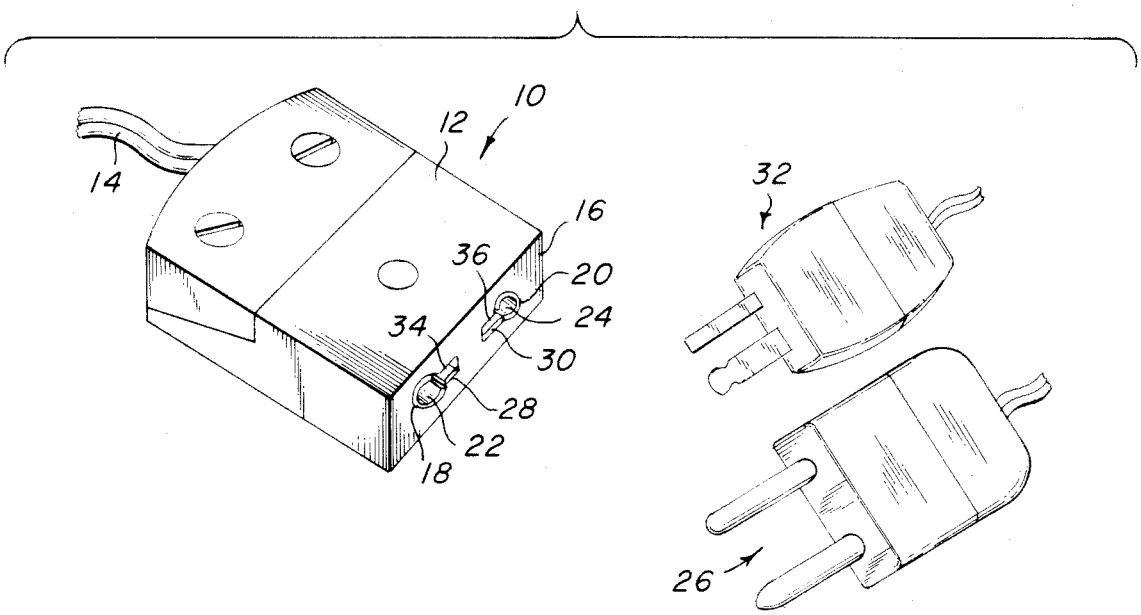
FIG. 2
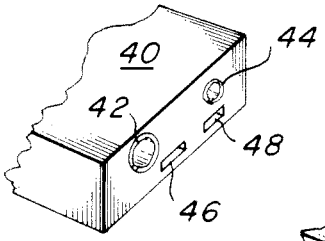
FIG. 3
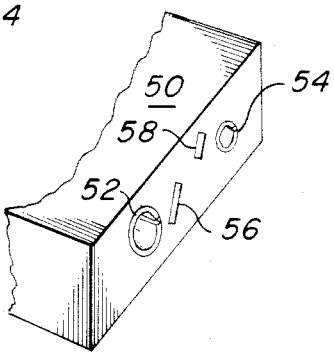
FIG. 4
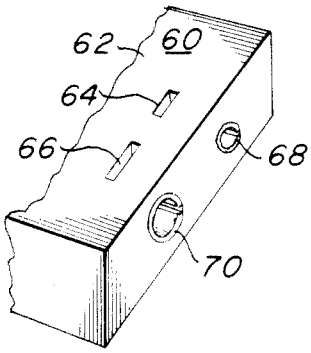
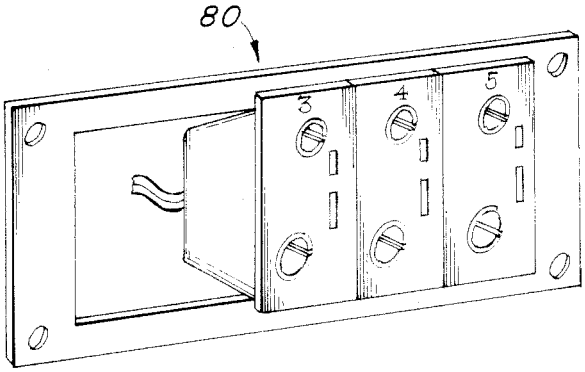
FIG. 5

UNIVERSAL CONNECTOR FOR THERMOCOUPLES

BACKGROUND OF THE INVENTION

In the electrical arts generally, and in thermocouple connector systems in particular, there arises the necessity to effect plug-and-socket connections between thermoelectric alloy lead pairs having male and female connectors of different sizes or types.

In modern temperature measurement, display, and recording equipment employing thermocouples, paired lead connectors, for example, are commonly of specifically differing sizes and plug or prong configurations, as a larger "standard" size, and smaller "miniature" or "subminiature" sizes. Such connectors are well known in the trade and are illustratively shown in the catalog reference publication of Omega Engineering, Inc. of Stamford, Ct. trademarked "Temperature Measurement Handbook and Encyclopedia", and identified as "OGP" or "OST" (standard), or "SMP" (miniature) connectors, among others.

Heretofore, in order to associate connectors of a particular thermoelectric alloy pair of differing sizes in a necessary temperature (or other physical parameter) measurement installation, it was required to either disassemble and remove one connector and attach a mating properly sized connector of the same calibration, or, to interpose yet another eletromechanical element therebetween, having, as required, standard-sized male or female elements on one end and miniature male or female elements on the other end thereof. Such interposed connectors, sometimes called "transition adaptors" are also known in the trade and are well shown in the aforesaid publication, for example.

While such transition adaptors are reliable and work well, and are certainly superior to the effort of substituting and rewiring connectors, the same nonetheless require the additional purchase and availablity when needed of the adaptor. Additionally, as yet one more element inserted in the line from the thermocouple to the recorder or readout device, there is unavoidably a further potential location for excess resistance, fault or other error in the measurement system, which it is clearly preferable to avoid. Further, each adaptor must be of a mating or compensating alloy, i.e., identical to both elements it joins.

There is, therefore, a practical and advantageous need for an improved system for effecting interconnection of differing sized connectors of the same thermoelectric alloy materials having conventionally nonmatching prongs or blades and receiving sockets in such environments.

SUMMARY OF THE INVENTION

The present invention uniquely embraces a connector of single size having female sockets therein so disposed as to receive either the standard or miniature male elements of the associated connector. The single universal connector of the invention may thus be substituted for and replace extant female connectors, whether of standard or miniature size. Furthermore, not only are the required differing types reduced in number to just one with the new connector, but also the previous necessity to provide a yet further transition adaptor of a mating thermoelectric alloy is obviated.

It follows therefrom that only a single female connector need be stocked and utilized in association with instruments, panel connectors, or any other leads associated with thermocouple systems and the like.

In the several forms of the invention, the universal connector includes laterally spaced female sockets for standard male connectors which are generally of circular cross-section, and of different sizes for polarization purposes, as is well known in the art with thermocouples, for example, whose leads are connected to differing metals or alloys. Additionally, the universal connector of the invention is provided with more closely spaced and narrow rectangular sockets for the flat blade connectors of miniature connectors.

In a preferred form thereof, the circular apertures for the standard-sized connector are respectively intersected by the slots for the miniature connector, all lying substantially in a straight line across the end of the connector body.

In other forms thereof, the miniature or blade slots (which also have differing width for polarization purposes) do not intersect the circular sockets, but lie on lines either parallel thereto or at an angle therewith.

In all cases, the internal contacts for the circular sockets and the blade slots are, appropriately respectively, connected to the leads from the connector body to its equipment or other mounting.

BRIEF DESCRIPTION OF THE DRAWINGS

FIG. 1 is a perspective view of a connector of the invention along with illustrative connector plugs used therewith;

FIG. 2 is a fragmentary perspective view of a modified form of the invention;

FIG. 3 is a fragmentary perspective view of another modified form of the invention;

FIG. 4 is a fragmentary perspective view of yet another modified form of the invention; and, FIG. 5 is a fragmentary perspective view of a further modified form of the invention employing a panel array.

DESCRIPTION OF THE INVENTION

As seen in the perspective view of FIG. 1, a universal connector of preferred form in accordance with the invention is shown at 10, and includes a connector body 12 of suitable material usually an insulating material such as a moldable polymer of thermosettable or thermoplastic nature, illustratively a glass-filled nylon composition or ceramic composition. The body at one end thereof has a two-wire lead 14 extending therefrom to associated equipment in usual manner.

Similarly, the body may be fabricated from two or more parts as is well known to permit assembly of the electrical leads with the socket or slot electrical contacts, the body parts being detachably connected as by machine screws or the like.

The opposite end face 16 of the connector body is uniquely provided with the dual female socketing for both standard and miniature connectors, and includes the larger circular sockets for standard connectors at 18, 20, wherein one socket, as that at 18, may be of slightly greater size for polarization purposes, as aforesaid.

Within the sockets 18, 20 are provided arcuate or substantially circular metallic contacts 22, 24 in generally known manner and which are appropriately mechanically and electrically connected to the lead 14, thereby to effect contact with the male circular plug elements of a standard connector, shown illustratively at 26.

Uniquely, the universal connector 10 further includes a pair or more closely spaced narrow slots 28, 30 for reception of the usual blades of a miniature-type connector, illustratively shown at 32. The slots 28, 30 include leaf or like metallic contacts 34, 36 associated therewith for appropriate electric contact in known manner, and likewise are similarly internally connected to the lead 14.

As shown, the blade slots 28, 30 for the smaller connector respectively intersect the circular openings 18, 20, and the series of four opening lies generally in a single straight line, enhancing ease of tooling and fabrication. It should be observed that polarization of small blade connectors is conventionally effected by having blades of differing widths, as shown. With the universal connector of FIG. 1, wherein the blade slots intersect the circular apertures, it is evident that the male connector might be improperly plugged, as the blade slots intersect the standard sockets, whereby the blade plug may be inserted incorrectly in reversed manner. Advantageously, however, the subject construction fairly precludes such possibility as the the sockets for the standard plug are of substantial size and readily visible to the technician, whereby the larger polarized socket serves as a visual flag that the larger blade of a miniature spade plug should be inserted thereat appropriately.

It will be seen, then, that when the universal connector 10 is employed with desired equipment to receive a connection from a thermocouple device or the like, that the single connector 10 may selectively receive either the larger standard plug 26 or a bladed miniature plug 32, whereby no disassembly, substitution, or adaptation is required.

A further form of the invention is shown in FIG. 2 wherein the connector body 40 includes spaced circular sockets 42, 44 for standard male connectors, but wherein the spade lug slots 46, 48 do not intersect the same but rather are aligned parallel thereto and slightly spaced therefrom. It will be seen that the left-hand blade slot 46 is of greater width than slot 48 reflecting conventional polarization technique, and in like manner, the larger blade slot is proximate to and electrically connected with the larger standard circular socket. As before, the internal connection is provided from each respective like polarized slot to the external connecting lead. Such a connector may even be duplexed with a second parallel set of blade slots above the circular sockets.

In the form of the invention shown in FIG. 3, the connector body 50 includes like standard circular sockets 52, 54, but in this form of the invention, the non-intersecting blade slots 56, 58 are disposed at an angle to the line of the circular sockets, and the miniature plug 32 would thus be slightly canted when connected.

This aspect of the invention provides two further features. Firstly, at any time upon visual perusal even from a distance it will be evident that if a canted connector relationship is present, then a miniature connector is in use, while if two connectors are substantially aligned, then a standard connector is present. Secondly, the angled arrangement permits the invention herein to be utilized with thinner and flatter connector bodies which otherwise would not have sufficient vertical space beneath the standard connector to incorporate the set of blade slots.

FIG. 4 shows yet another form of the invention wherein the connector body 60 may be of such thin and flat dimensions so as to be unable to accommodate the set of blade slots on the end face thereof. In such case, the top wall 62 of the body may be provided with blade slots 64, 66 and contacts therein intersecting the circular sockets 68, 70 on the body end face at substantially right angles thereto. As with FIG. 3, this form of the invention provides an immediate visual indication as to which type of male connector is associated with the universal connector.

In the several illustrative forms of the invention, the universal connector body shown is of a well known type having a removable smaller rear portion thereon, as the "OGP" connector marketed by Omega Engineering, Inc. Obviously, within the spirit and scope of the invention, the fabrication or assembly of the body proper may partake of various forms, as fully longitudinally divided like halves, for example, or other known forms.

Further, while the connector body at 10 and in other figures is shown as a unit handled assembly with an appropriate lead therefrom to equipment, the invention embraces providing the connector body as elements associated with a multi-jack panel assembly, as seen at 80 in FIG. 5, and wherein the connector body on the exposed end face thereof in the panel may partake of several of the disclosed universal connector forms set forth hereinabove, the form of FIG. 2 being illustrated.

What I claim is:

1. A universal polarized connector for thermocouple connections and the like comprising, a body having a first pair of sockets therein, said sockets being substantially circular and having differing diameters to visually indicate polarization, and a second pair of sockets therein, said second pair of sockets respectively having an elongated slot-like configuration, said second pair slot sockets lying in spaced end-to end relation substantially in a plane extending through the longer dimension of said slot sockets and substantially parallel to a line joining said circular sockets, each slot of said second pair along intersecting a respective said circular slot to be open therewith whereby polarized varying-width blades of a plug member when inserted into said second pair of sockets may extend partially into said first pair of circular sockets, means providing thermoelectric alloy contact within each said socket, means interconnecting a respective one of said contacts of said first pair with the intersecting one of said contacts of said second pair, and, lead means extending from said contacts.

2. A universal connector for thermocouple connections and the like comprising, a body having a first pair of sockets therein, said sockets being substantially circular and having differing diameters to visually indicate polarity, and having a second pair of sockets therein having a slot-like confiiguration, with the slots of said second pair having differing widths to visually indicate polarity, means providing a respective contact within each said socket for thermoelectric alloy leads, means interconnecting each respective one of said contacts of said first pair with a respective one of said contacts of said second pair, said connector body having a configuration for panel mounting with said sockets exposed on an end face thereof, and, said socket pairs being disposed in spaced parallel relation on said body end face.

3. The universal connector of claim 2 further including a panel member configured to receive and mount a plurality of thermocouple connectors in side-by-side relation, and, a plurality of said universal connectors mounted therein in side-by-side relation.

4. The universal connector of claim 2 wherein said slot-like sockets in their width dimension lie substantially in a common plane and substantially parallel to a line joining said circular sockets, each of said slot sockets respectively intersecting a said circular socket.

* * * * *